US006334821B1

(12) United States Patent
Kita

(10) Patent No.: US 6,334,821 B1
(45) Date of Patent: Jan. 1, 2002

(54) TETHERED PRACTICE APPARATUS FOR A BALL GAME

(76) Inventor: Shigeru Kita, 2-2-3 Showa-cho, Abeno-ku, Osaka (JP)

( * ) Notice: Subject to any disclaimer, the term of this patent is extended or adjusted under 35 U.S.C. 154(b) by 0 days.

(21) Appl. No.: 09/073,673

(22) Filed: May 6, 1998

(51) Int. Cl.[7] ..... A63B 69/00
(52) U.S. Cl. ..... 473/430; 473/422; 473/423
(58) Field of Search ..... 473/430, 422, 473/423, 431, 426, 427, 428, 429, 439

(56) References Cited

U.S. PATENT DOCUMENTS

| | | | | |
|---|---|---|---|---|
| 2,282,766 A | | 5/1942 | Miremont | 473/415 |
| 3,271,030 A | | 9/1966 | Mueller | 473/423 |
| 3,367,655 A | | 2/1968 | Navran | 473/430 |
| 3,494,621 A | | 2/1970 | Windall | |
| 3,994,494 A | | 11/1976 | Kelley | 473/430 |
| 4,129,110 A | | 12/1978 | Kubrak | 124/16 |
| 4,322,075 A | | 3/1982 | Hynes | 473/430 |
| 4,502,684 A | * | 3/1985 | Rocha | 473/429 |
| 4,660,835 A | | 4/1987 | Locurto | |
| 4,706,964 A | | 11/1987 | Genovese | 473/575 |
| 4,864,772 A | * | 9/1989 | Ecklund | 49/59 |
| 4,898,385 A | | 2/1990 | Love | 473/430 |
| 4,902,012 A | | 2/1990 | Kita | 473/430 |
| 4,993,709 A | | 2/1991 | Tominaga | 473/430 |
| 5,048,828 A | | 9/1991 | Love | 473/430 |
| 5,098,094 A | | 3/1992 | Kita | 473/423 |
| 5,135,219 A | | 8/1992 | McKeon et al. | 473/430 |
| 5,386,986 A | | 2/1995 | Gamboa | 473/430 |
| 5,467,978 A | | 11/1995 | Paluch | 473/429 |
| 5,474,032 A | | 12/1995 | Krietzman et al. | 119/708 |
| 5,503,389 A | | 4/1996 | Campbell | 473/430 |
| 5,542,661 A | | 8/1996 | Gregan | 473/423 |
| 5,681,168 A | | 10/1997 | Brown | 473/219 |
| 5,853,334 A | | 12/1998 | Winebrenner | 473/142 |

FOREIGN PATENT DOCUMENTS

| | | |
|---|---|---|
| EP | 0311001 | 4/1989 |
| FR | 2155161 | 5/1973 |
| GB | 1989 | 8/1911 |
| GB | 205524 | 11/1923 |
| GB | 491536 | 9/1938 |
| GB | 2070444 | 9/1981 |
| JP | 35-14304 | 6/1960 |
| JP | 62-24873 | 2/1987 |
| JP | 3-122872 | 12/1991 |
| JP | 4-37472 | 3/1992 |
| WO | WO 8200008 | 1/1982 |

* cited by examiner

*Primary Examiner*—Jeanette Chapman
*Assistant Examiner*—M. Chambers
(74) *Attorney, Agent, or Firm*—Webb Ziesenheim Logsdon Orkin & Hanson, P.C.

(57) ABSTRACT

A ball game practice apparatus comprising a ball, a practice apparatus main body that hangs the ball and at the same time regulates the ball flying range, the practice apparatus main body possessing a frame that can hang the ball at a specified position via an elastic means and a column for supporting this frame, wherein the elastic means comprising a frame connection extended along the frame and mounted to the frame and a ball connection that hangs the ball, characterized by the frame connection of the elastic means mounted to the frame which is turned back by at least a pair of turn-back portions with a rotatable turn-back mechanism.

14 Claims, 6 Drawing Sheets

TETHERED PRACTICE APPARATUS FOR A BALL GAME

BACKGROUND OF THE INVENTION

1. Field of the Invention

The present invention relates to a practice apparatus for a ball game, such as tennis and, more specifically, to a practice apparatus equipped with a main body which can control the range of the ball's flight.

2. Description of the Prior Art

Because this kind of practice apparatus for ball games, such as tennis, is able to be used for exercise in a comparatively small space, it is convenient for a wide variety of players from beginners to experts. Practice apparatus with a wide variety of functions have been developed to simulate actual game conditions so that practice similar to an actual game condition can be experienced in order to improve one's skill level. The present invention provides a practice apparatus that can achieve ball returns close to those which occur in actual play by selecting suitable elastic means for attaching to the ball without adopting conventional methods that depend only on the elasticity of rubber (U.S. Pat. Nos. 4,902,012, 5,098,094).

In the case of conventional techniques, in an effort to portray the flight condition of balls in actual play, the elastic means connected to the ball must have an excessive length and, consequently, a large distance is required from the column to the position of the hanging ball, resulting in an excessive height, and, thus, the entire apparatus becomes cumbersome, which is a distinct disadvantage.

In addition, because the ability to achieve a variety of returns depends on the fixed tilting angle provided at a rebounding board, there is no denying that returns are monotonous to a certain extent.

Another disadvantage in the conventional technique is that the length of elastic rope to which the ball is tethered becomes twisted because of the accumulation of ball rotations generated during lengthy practices. Due to this twist, the ball tethering length becomes excessively short or comes in contact with the rubber fixed to a frame at one point, creating the possibility of damage to the contact point.

Under these circumstances, it is the main object of the invention to provide a ball game practice apparatus which solves the problems of conventional techniques, and to reproduce the trajectory of a batted ball close to that of actual play without making the size of the apparatus unwieldy.

In addition, it is a further object of the invention to provide a ball game practice apparatus that can produce a variety of returned ball flights similar to those experienced in actual games.

It is a still further object of the invention to provide a ball game practice apparatus with an improved elastic means durability.

SUMMARY OF THE INVENTION

A ball game practice apparatus according to the invention comprises a ball, a practice apparatus main body from which the ball hangs and at the same time regulates the range of the flight of the ball, a frame mounted upon the practice apparatus main body that can hang the ball at a specific position via an elastic means, and a column for supporting this frame. The elastic means comprises a frame connection extending along the frame and further comprises a ball connection from which the ball hangs. The subject invention is characterized in that the frame connection of the elastic means mounted to the frame includes at least a pair of turned-back portions with a rotatable turn-back mechanism.

If the practice apparatus is configured in this way, when the elastic means extends as the ball is hit, the frame connection that is turned back from the turn-back portions has sufficient length and can eliminate resistance at the turn-back portion as much as possible, thereby allowing the elastic means to smoothly extend, recreating the trajectory of a ball when hit in actual game conditions. Even an exerciser who hits the ball hard and with great force may achieve satisfactory extension of the elastic means, and, thus, satisfactory height and distance of the ball. In addition, because the rebounding ball is returned with the elastic force of a sufficiently extended elastic means, it produces a natural effect.

It is preferable that the turn-back mechanism of the turn-back portion is isolated and turns back the frame connection in such a manner to avoid contact between passing portions of the frame connections.

In this way, it is possible to prevent generation of contact resistance caused by overlapping of frame connections, and the flight path of the ball can be more accurately simulated to actual game conditions. In addition, if the number of turn-back connections are increased to secure the extension rate of the frame connections, contact with the relevant elastic means that comprise these frame connections can be avoided. As a result, unnatural ball flight paths due to contact resistance between the elastic means does not occur, and it is possible for a person to more closely simulate actual play.

The frame may be configured to be rotatably pivoted to the column.

If the practice apparatus is configured in this way, hitting the ball hung on the frame rotates the frame around the axis of the column that supports the frame. It is therefore preferable that a wide range of trajectories for return balls like those in actual play can be obtained utilizing but without rearranging the rebounding board.

A rotation restrictor to limit the range of rotation of the frame that rotates around the column may be provided.

Because configuring in this way can restrict the range of motion of the frame on which the ball is hung, it is possible to carry out more controlled returns, and continuous rallies can be experienced, which are desirable in practice sessions.

In a preferred embodiment of the invention, the ball connection of the elastic means comprises a plurality of loops. Each of these loops is connected via a twist straightening mechanism. Furthermore, the contact position of the ball connection can be varied.

This configuration can eliminate detrimental effects caused by twisting of the elastic means arising from rotation of the elastic means even when the strongly hit ball is violently rotated. This configuration can improve the durability without generating damage to the elastic means, at the same time enabling the continuation of controlled ball hitting exercises. Even if the exercise is continued for a long time, it is possible to avoid contacting the ball in the same place by changing the contact position of the elastic means comprising the ball connection, effectively reducing wear and tear of the contact place, and remarkably improving the durability of the whole apparatus.

A rebounding board may be installed ahead of the flight path of the ball.

In the present invention, the rebounding board is not always required, but installing a rebounding board ahead of the flight path of the ball offers more variability in the trajectory of return balls, which is preferable.

When the ball rebounding board has a changeable surface angle, still more variability in the trajectory of return balls can be obtained, which is also preferable.

It is also possible to install a target equipped with a return prevention mechanism that captures the flown ball.

This configuration will assure that the ball hits the target even when it is difficult to verify at high speed.

A downward displacement restrictor for restricting the downward displacement of the frame connection of the elastic means may be installed to the frame of the invention.

Configuring in this way can restrict the downward displacement of the ball even when the ball is hit hard, and it is convenient that the return ball is easy to return to the original hung position.

The downward displacement restrictor installed near one end of the frame may comprise combinations of a plurality of annulus rings of varying sizes.

Configuring in this way can effectively reduce contact resistance between the elastic means and annular rings at individual annular rings because the ball load is distributed to a plurality of annular rings, and it is desirable that the flight of the ball upon being struck simulates an unrestricted, naturally struck ball.

It is preferable that at least one of the downward displacement restrictors is equipped with an isolating mechanism for reducing contact with the elastic means.

As the ball is hit, the elastic means connected to the ball is pulled with a strong force and comes in contact with the elastic means existing in parallel, but if the contact of these elastic means is excessive, resistance may be generated in movement of the elastic means or eventually damage to the elastic means may occur. As a result, the durability of the elastic means is detrimentally affected and at the same time, the flight path of the struck ball is restricted unnaturally, which is not desirable. Consequently, providing this kind of isolating mechanism not only increases the life of the elastic means but also permits the flight of the struck ball to simulate that of an actual struck ball.

DETAILED DESCRIPTION OF THE PREFERRED EMBODIMENTS

Figure 1:
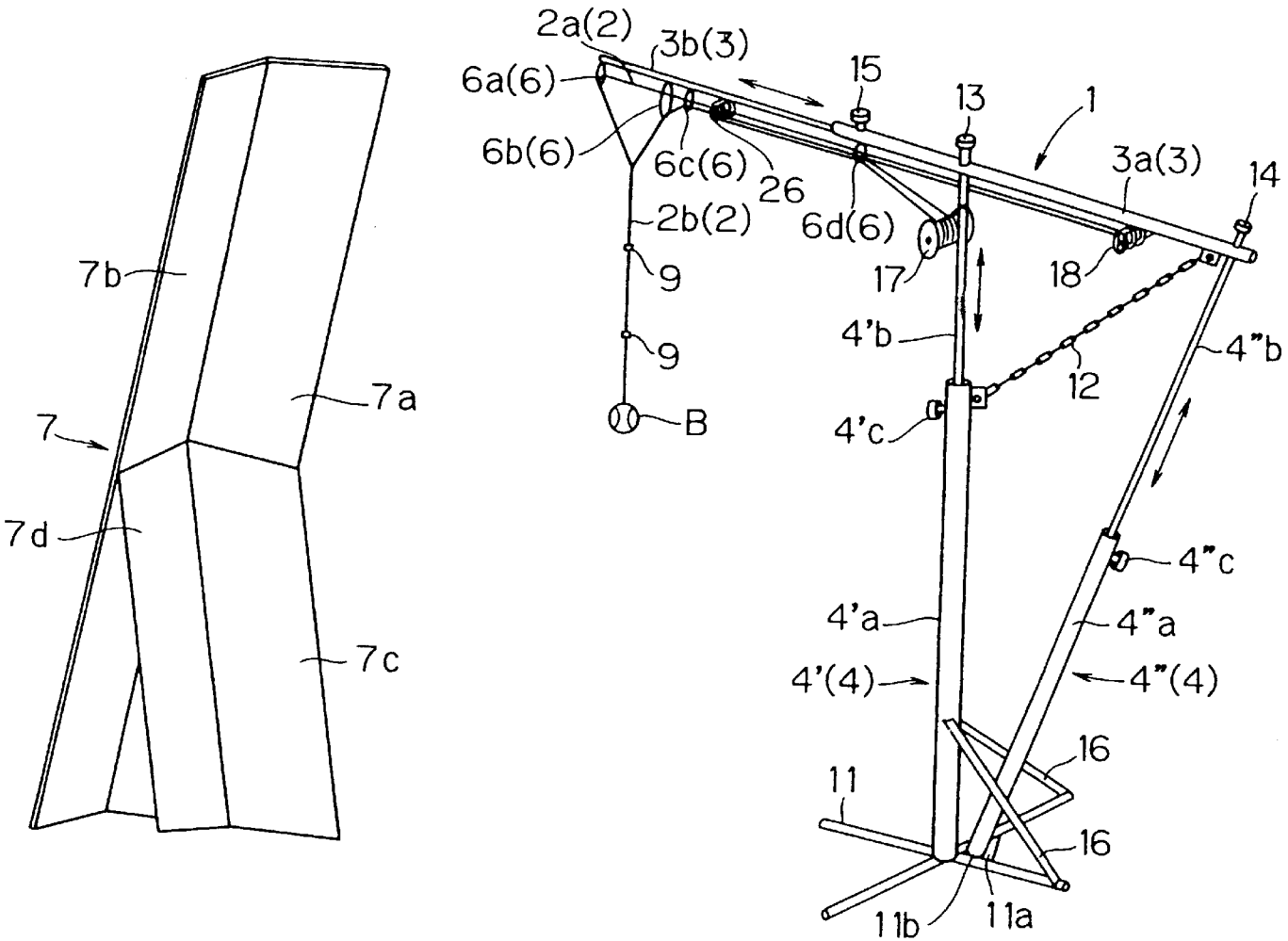
FIG. 1 is a perspective view showing the overall arrangement of a ball game practice apparatus according to the invention.

Referring now to the drawings, the embodiments of the ball game practice apparatus according to the invention will be described in detail hereinafter using a tennis practice apparatus for an example.

FIG. 1 shows an overall construction of a tennis practice apparatus equipped with a practice apparatus main body 1 from which a ball B is hung, and a rebounding board 7 against which the struck ball B rebounds. The practice apparatus main body 1 comprises a frame 3 from which the ball B hangs at a specified position via an elastic means 2 and a column 4 that supports the frame 3. The column 4 further comprises a main column 4' that rotatably supports the frame 3 with the nearly center portion of the frame 3 as the rotating center, and a sub-column 4" that supports the other end portion opposite to the position (one end side) from which the ball B hangs, at one end portion of the frame 3. The main column 4' is preferably about 1600–2000 mm (63–79 inches) high. The main column 4' and sub-column 4" form pipes and are of a telescopic construction. That is, the extending portions 4'*b*, 4"*b* that can extend upwards from each of the bases 4'*a*, 4"a at the lower part of the main column 4' and sub-column 4" are able to be housed inside the pipe that composes the bases of the column 4' and sub-column 4", respectively. These columns 4', 4" shown in FIG. 1 can be extended in two stages, but they may be extended in multiple stages or may be in a fixed length that does not extend. When the extending portions 4'*b*, 4"*b* are extended to a specified length, they can be fixed in place by general screw type stoppers 4'*c*, 4"*c*.

To the lower end portion of the main column 4', legs 11 extend in four directions so that the main column 4' can be stably erected and secured by welding. The length, thickness, etc. of the legs 11 may be any size that enables stable erection of the column. However, the lower end portion of the sub-column 4" is not secured to the main column 4" and the legs 11, but is loosely inserted and fitted in a through hole 11*b* formed in a triangle plate la stretched across the intersection of two pieces of legs 11 and secured by welding in a depth that would not allow the sub-column to easily dislodge. That is, the lower end portion of the sub-column 4" is supported at one point in such a manner to enable it to make precession around the main column 4'. Naturally, the lower end portion of the sub-column 4" is not limited to the system for inserting the lower end portion of the sub-column 4" into the hole 11*b* formed in the triangle plate 11*a* but may be supported at one point by another configuration if the lower end portion does not easily move upwards and dislodge as a result of the strike force of the ball B.

Figure 2:
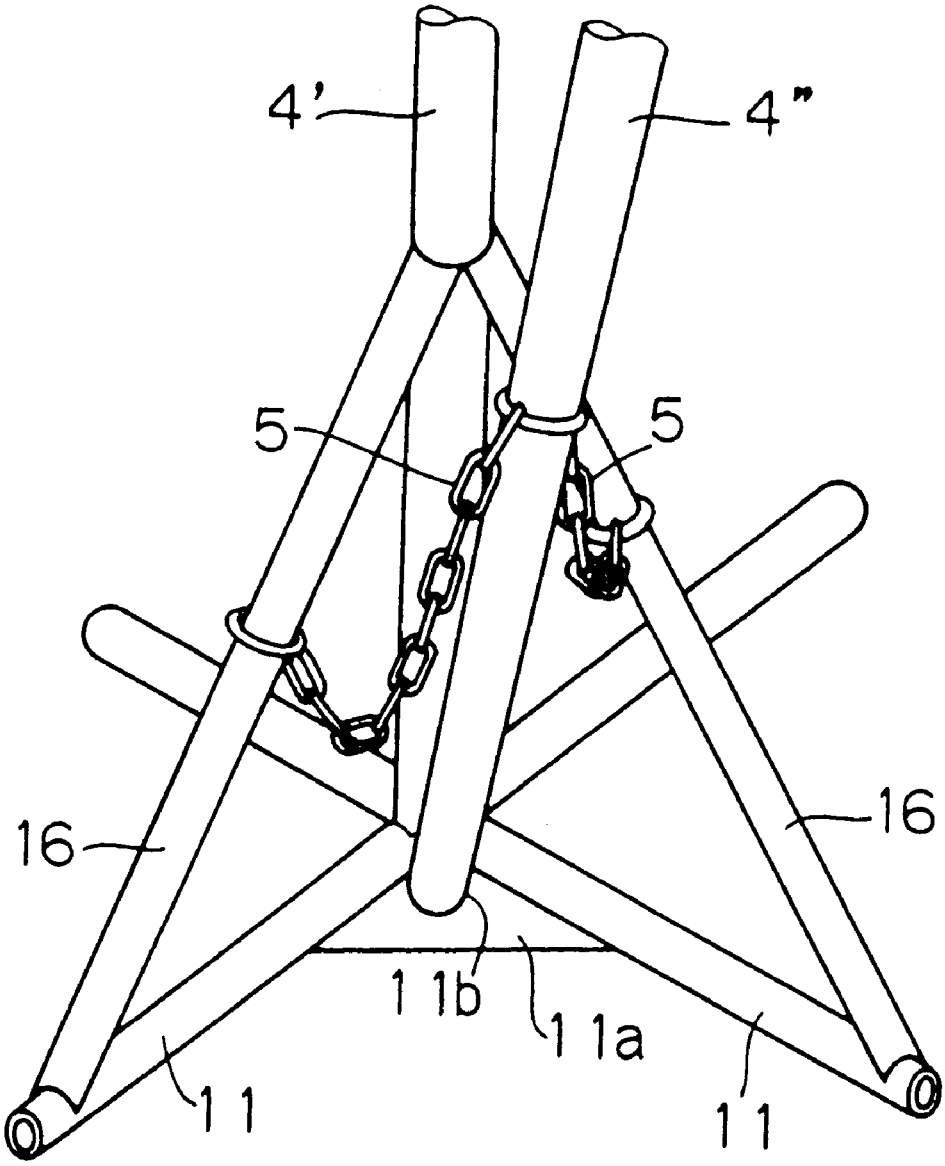
FIG. 2 is an enlarged perspective view of the lower part of the column of the practice apparatus proper shown in FIG. 1.
Figure 3:
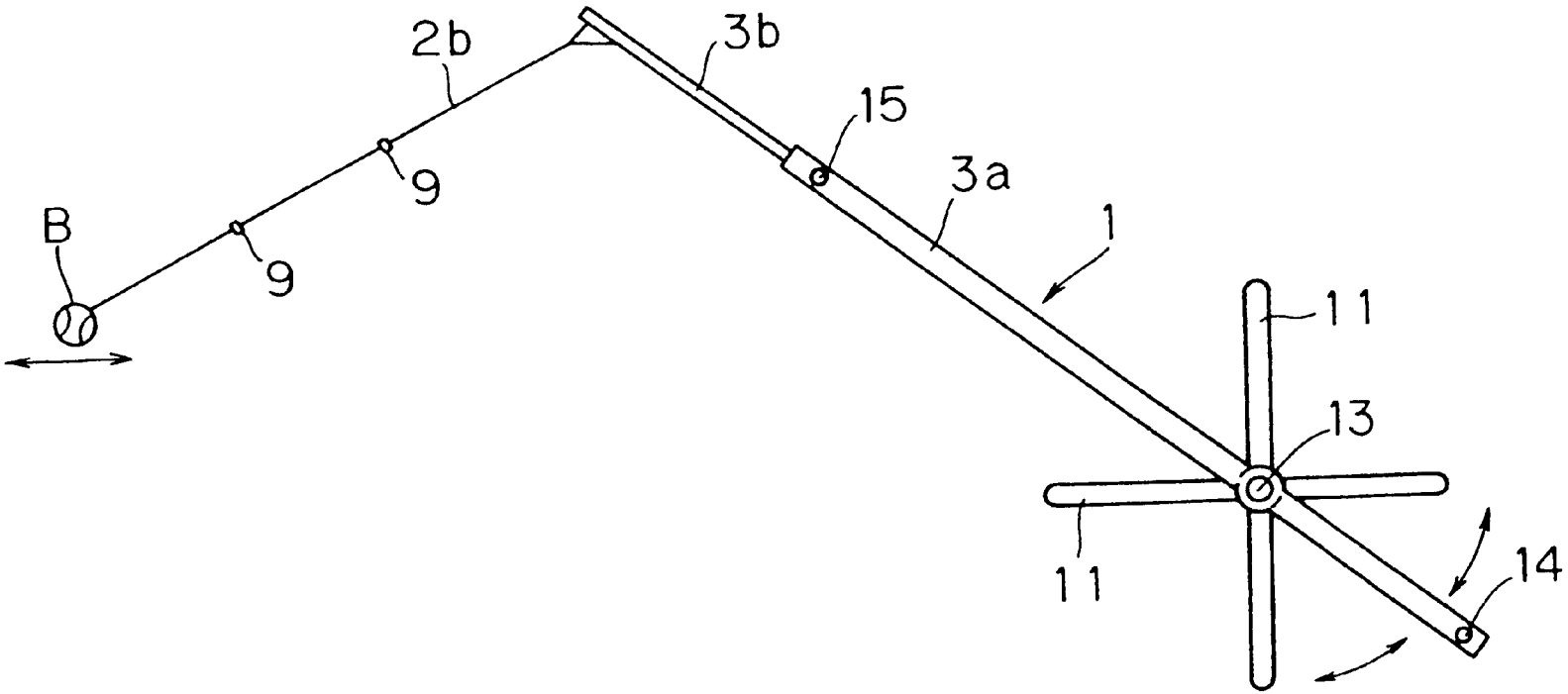
FIG. 3 is a plan view explaining the operation of the practice apparatus proper shown in FIG. 1.

Because the lower end portion of the sub-column 4" is supported at one point to enable it to slowly rotate around the main column 4', rotative movement of the sub-column 4" is generated by the hitting of a ball by the user and the frame 3 rotates and moves following the movement of the ball B as the ball B flies, as shown in FIG. 3. In such an event, it is convenient to install a rotation restrictor 5 for restricting the rotation range of the frame 3 as shown in FIG. 2, so that the movement of the frame 3 can be controlled. This rotation restrictor 5 comprises two pieces of chains with some allowance in length which connect two column supporting members 16 that reinforceably support the leg 11 of the main column 4' to the sub-column 4". When the sub-column 4" makes precession and moves as the ball B is hit, either one of the two chains composing the rotation restrictor 5 operates in the direction to restrict the movement of the sub-column 4". If a chain hitching section is provided on either the sub-column 4" side to which the chain is connected or on the column supporting member 16 side, the degree of allowance can be adjusted and, in addition, the restriction range can be changed. That is, if further changes of the return ball after hitting are desired, the allowance of the rotation restrictor 5 should be increased, and further, the rotation restrictor 5 may be removed. With this configuration, it becomes possible to provide changes to the trajectory of the return ball without depending on the profile of the rebounding board, in particular, the rebounding angle, as in the case of conventional techniques, and simulations close to actual play can be carried out. It is also possible to use strings, ropes, belts, wire, etc. in place of the chains used for the restrictor 5.

It is preferable to connect the main column 4' to the other end portion of the frame 3 opposite to one end portion to which the ball B is hung, with another chain 12 so that the sub-column 4" is not subject to unintentional variations and achieves stable movement in a specified range even when the player makes a violent hit on the ball.

The main column 4' and the frame 3 are pivotally connected by screwing a stopper 13 into the top threaded on the inside of the extending portion 4'*b* of the main column 4' which passes through the frame 3 and at the same time supporting the frame 3 to a protrusion (not illustrated) provided on the outside of the extending portion 4'*b* of the main column 4'. Similarly, the sub-column 4" and the other end portion of the frame 3 are pivotally connected by screwing a stopper 14 into the top threaded on the inside of the extending portion 4"*b* of the sub-column 4" which passes through the frame 3. At the same time the frame 3 is supported by a protrusion (not illustrated) provided on the outside of the extending portion 4"*b* of the sub-column 4". Naturally, if the chain 12 for connecting the main column 4' to the other end portion of frame 3 is provided, the stopper 14 does not have to laterally and vertically restrain the frame 3, but may only have a function to prevent the other end side of the frame 3 from vertically coming out from the sub-column 4". The distance from the stopper 13 to the stopper 14 is preferably about 300–800 mm (12–31 inches).

The frame 3 forms a pipe in a similar manner as in the case of the main column 4' and sub-column 4" and is of a telescopic construction. From the base 3*a* to the tip end side of the frame 3, a telescopic extending portion 3*b* is housed in the pipe composing the base 3*a*, and when the extending portion 3*b* is extended to a specified position, it is fixed in place with the stopper screw 15 installed at the base 3*a*. This frame 3 may not be of a telescopic system as illustrated but may be of a fixed length system. Specifically, the frame 3 is desirable to be about 2000–4000 mm (79–157 inches).

On the bottom side of the frame 3, an elastic member 2 comprising rubber is placed along the longitudinal direction of the frame 3. This elastic member 2 comprises a frame connection 2*a* along the longitudinal direction of the frame 3 and a ball connection 2*b* which is connected to the frame connection 2*a* and extends downward from the vicinity of one end portion of the frame 3 to the ball B. Of the elastic means, the frame connection 2*a* is vertically supported by the downward displacement restrictor 6 attached to the frame 3. Since the downward displacement of the ball can be restricted to a certain extent by the downward displacement restrictor 6 even when the ball is hit hard, the ball returns easily to the original hanging position, which is convenient for continuing hitting practice.

The downward displacement restrictor 6 comprises combinations of a plurality of annular rings 6*a*, 6*b*, 6*c* of varying sizes installed in the vicinity of one end portion of the frame 3 and an annular ring 6*d* installed to the bottom nearly at the center portion in the longitudinal direction of the frame 3. The annular ring 6*a* is installed near the top end of one end portion of the frame 3 and to the bottom of the frame 3, closer to the column, an annular ring 6*b* slightly larger in diameter than that of the annular ring 6*a* is installed. Between these annular rings 6*a*, 6*b*, the ball B is positioned to hang down. The annular ring 6*c* has a diameter nearly the same as that of the annular ring 6*a* on one end portion side and is installed on the bottom of the frame 3 closer to the column than the annular ring 6*b*. The annular ring 6*b* is not always necessary as a downward displacement restrictor 6, but slightly increasing the diameter of the annular ring 6*b* from that of the annular ring 6*a* can disperse the load of ball B to annular rings 6*b* and 6*c* and, as a result, the contact resistance between the elastic member and each of the annular rings can be effectively reduced, and the flight of the ball as a result of hitting the ball B becomes free of restriction and close to that of a naturally hit ball, which is preferable. Naturally, on the annular ring 6*a* side, a combination of annular rings 6*b* and 6*c* may be provided. Furthermore, the number of annular rings with varying diameters may be increased.

Figure 5:
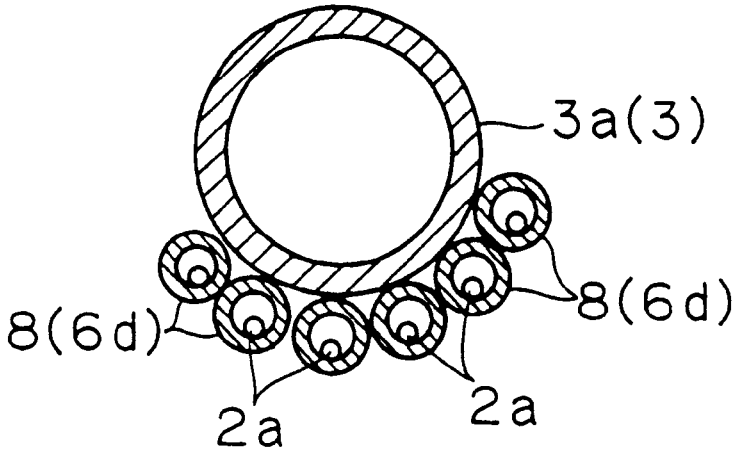
FIG. 5 is an enlarged sectional view of the isolating mechanism.

The annular ring 6*d* installed on the bottom at nearly the center portion in the longitudinal direction of the frame 3 may have a configuration similar to that of annular rings 6*a*, 6*b*, 6*c*, but it is preferable to be configured to have an isolating mechanism 8 equipped for isolating each of the elastic means individually as shown in FIG. 5. If configured in this way, when the frame connection 2*a* of the elastic means is composed with a plurality of pieces as described later, the resistance caused by mutual contacts generated as a result of hitting of the ball B can be eliminated as much as possible, which is convenient. This isolating mechanism 8 comprises a plurality of short pipes and each pipe is designed to allow one piece of connection 2*a* to pass, and is installed to the outer circumference on the bottom side of the base 3*a* of the frame 3 by a joining means such as adhesives or welding. The profile of each pipe that composes the isolating mechanism 8 should be such that the elastic means can smoothly slide inside. In addition, the pipe inside of the isolating mechanism 8 may be provided with resin coating such as Teflon™, which is a trademark owned by the E. I. Dupont de Nemours and Company so as to provide low friction inside the pipe. The annular rings 6*b*, 6*c* may have the configuration equipped with the isolating mechanism 8 in a similar manner.

Next, the route of the elastic means of the frame connection 2*a* will be discussed. The frame connection 2*a* of the elastic means originates from the elastic means winding reel portion 17 mounted in the vicinity of the top end of the extending portion 4'*b* of the main column 4'. The frame connection 2*a* of the elastic means extends toward one end side of the extending portion 3*b* along the longitudinal direction of the frame 3. The frame connection 2*a* passes through the inside of the isolating mechanism 8 in the annular ring 6*d* and has its direction changed by the front end side, turn-back portion 26 equipped with the turn-back mechanism later discussed. The frame connection 2*a* then passes through the inside of the isolating mechanism in the annular ring 6*d* again and has its direction changed by the rear end side, turn-back portion 18 later discussed. The frame connection 2*a* again passes through the inside of the other isolating mechanism 8 in the annular ring 6*d*. Then, the frame connection 2*a* further passes through the annular ring 6*c*, then the inside of the annular ring 6*b*, and advances as it crosses the ball connection 2*b* of the elastic means later described. If configured in this way, the frame connection 2*a* of the elastic means is positively extended to the length exceeding the distance between the elastic means winding portion 17 to the intersection with the ball connection 2*b* of the elastic means as the ball B is hit. Therefore, the extension of sufficient length is secured at this portion as the ball is hit, and the flight of the ball achieves flight close to that achieved in actual play, which is preferable.

Figure 4:
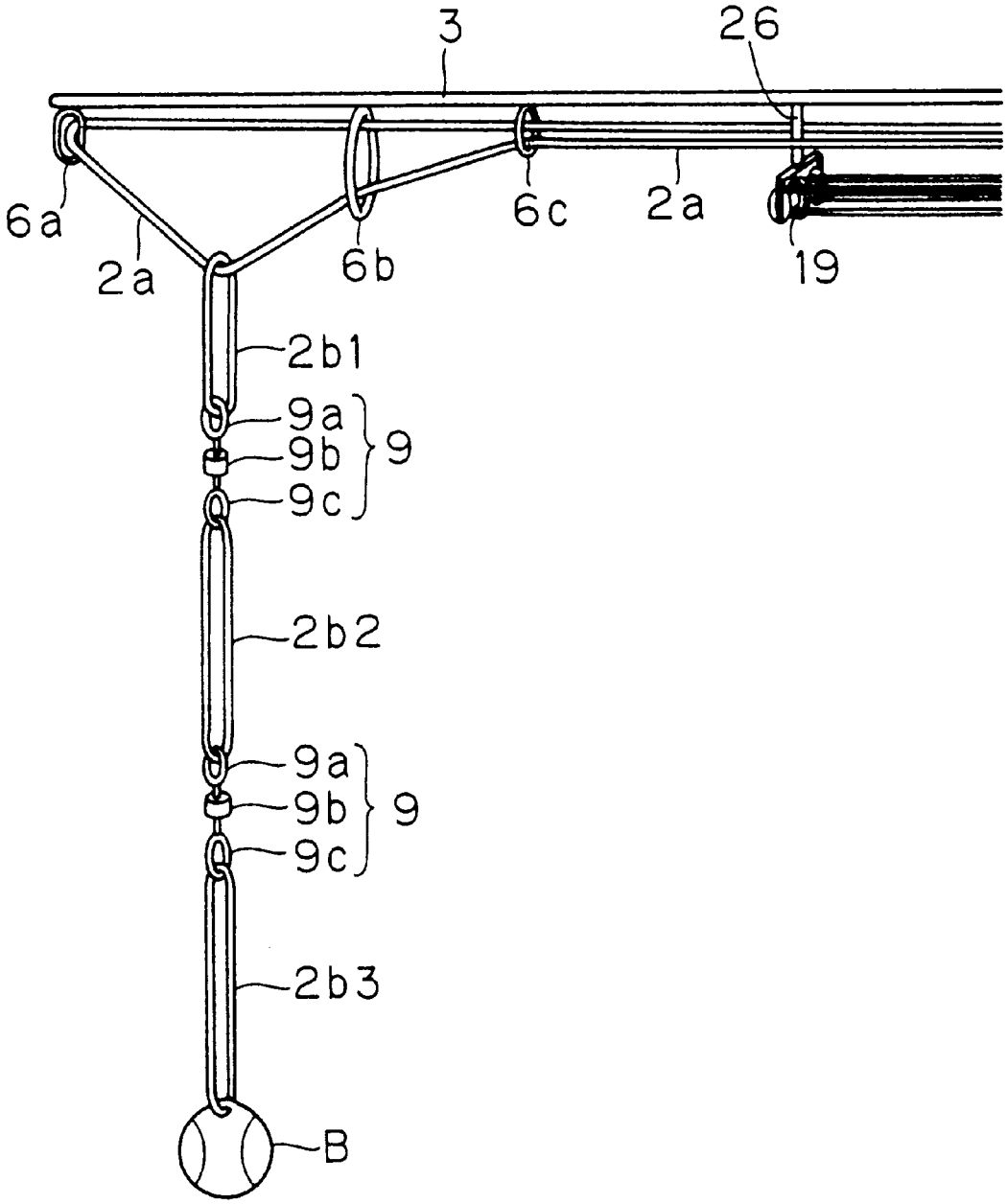
FIG. 4 is an enlarged perspective view of the ball connection of the elastic means.
Figure 6:
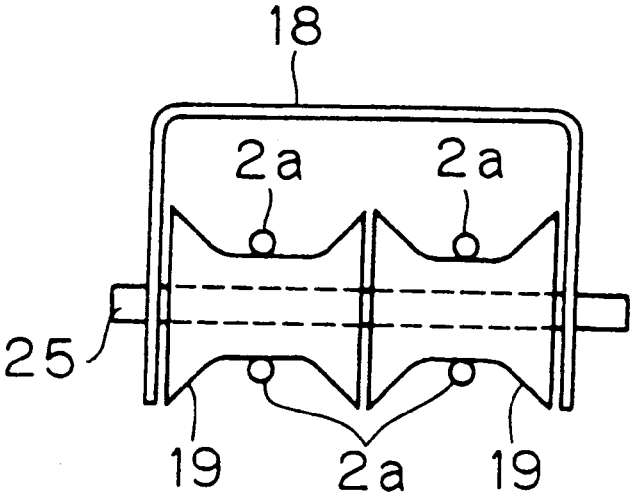
FIG. 6 is an enlarged side view of the turn-back section.

In addition, the elastic means of the frame connection 2*a* enters from the inside of the annular ring 6*a* mounted in the vicinity of the top end of one end portion of the frame 3 and first swings outwards, and then passes through the inside of each of the annular rings 6*b*, 6*c* towards the original direction. The elastic means of the frame connection 2*a* is guided in the opposite direction after it reaches the rear end side, turn-back portion 18 equipped with the turn-back mechanism mounted to the other end side of the frame 8 as shown enlarged in FIG. 6. The elastic means of the frame connection 2*a* reaches the annular ring 6*d* where it also passes through the inside of another isolating mechanism 8 and reaches the front end side, turn-back portion 26 equipped with the turn-back mechanism. The front end side, turn-back portion 26 may be configured in a manner similar to that of the rear end side, turn-back portion 18 shown in FIG. 6 and is mounted to the lower portion on this side of the annular ring 6*c* in the vicinity of one end side of the extending portion 3*b* of the frame 3 as shown in FIG. 1 and FIG. 4. It is preferable to install the front end side, turn-back portion 26 at a distance of about 150–400 mm (6–16 inches) from the top end of one end side of the extending portion 3*b* of the frame 3. In addition, the frame connection 2*a* is guided in a different direction by the front end side, turn-back portion 26 and passes through the inside of the other isolating mechanism 8 of the annular ring 6*d*, and finally returns and is fixed to the elastic means winding reel portion 17. Now, the rear end side, turn-back portion 18 and the front side, turn-back portion 26 compose one pair of turn-back portions.

Naturally, the elastic means of the frame connection 2*a* that passes the front end side, turn-back portion 26 may be allowed to further reach the rear end side, turn-back portion 18 and repeat turn-backs again, and in such an event, the frame connection 2*a* is further extended. This further increases the extension of the elastic means, which is particularly suited for a person who is good at hard hitting.

The rear end turn-back portion 18 and the front end turn-back portion 26 are configured to be equipped with a pulley 19, both of which space apart the frame connection 2*a* as it passes vertically without coming into contact with each other, and the pulley 19 is pivoted to the shaft 25 to enable smooth rotation. The pulley 19 comprises a turn-back mechanism. The number of channels in the pulley 19 may be increased and decreased as required in accordance with the number of elastic means that passes around the pulleys. In short, the number of pulleys is selected to avoid contact between elastic means as much as possible and to prevent associated contact resistance. The surface of the pulley 19 is preferably smooth enough to minimize contact resistance with the frame connection 2*a* of the elastic means. Preferably, the surface is coated with Teflon™, which is a trademark owned by the E. I. Dupont De Nemours and Company to describe a coating. The pulley 19 itself may be comprised of a ball bearing or a ball bearing may be built in for the contact between the pulley 19 and the shaft 25.

By sufficiently securing the length of the elastic means of the frame connection 2*a* in this way, ball striking practice close to actual play can be achieved without generating unnatural resistance to extension of the elastic means by the hitting of ball B. The number of direction changes of the frame connection 2*a* of the elastic means is naturally not limited to this embodiment, but may be further increased or decreased.

On the other hand, as seen in FIG. 4, the ball connection 2*b* of the elastic means comprises a first connection 2*b*1 of annular form in contact with the elastic means of the frame connection 2*a*, a second connection 2*b*2 located below and connected via a twist straightening mechanism 9, and a third connection 2*b*3 connected via another twist straightening mechanism 9. Naturally, the number of these connections is not limited to this, and, similarly, the number of twist straightening mechanisms 9 may be changed as required in accordance with the number of connections. The first connection 2*b*1, second connection 2*b*2, and third connection 2*b*3 are set to nearly the same length, but these lengths may be varied as required.

Specifically, the hanging length of the annular first connection 2*b*1 is about 200–400 mm (8–16 inches). Those of the second connection 2*b*2 and the third connection 2*b*3 are preferably about 300–600 mm (12–24 inches).

The twist straightening mechanism 9 comprises top and bottom annular rings 9*a*, 9*c* in contact with the elastic means and a jig 9*b* which connects these two annular rings 9*a*, 9*c* and rotatably fitted to an attachment provided from one end of the annular rings 9*a*, 9*c*. Installing this twist straightening mechanism 9 can alleviate the burden caused by the twist at the connections of individual elastic means even when the ball hit by the exerciser rapidly rotates. This is preferable in improving the durability of the elastic means. In addition, because the ball connection 2*b* of the elastic means is divided and formed in a plurality of loops, it is possible to move and change the contact point between the annular rings 9*a*, 9*c* and the ball connection 2*b* comprising the twist straightening mechanism 9 as required. In this way, repeated contact at the same position on the ball connection 2*b* can be avoided. Therefore, the life of the ball connection 2*b* of the elastic means can be remarkably improved, which is preferable. This concept may also be applied to the contact between the ball connection 2*b* and the frame connection 2*a*. That is, because the ball connection 2*b* of the elastic body is formed in a loop, point contact of both connections can be avoided. The frame connection 2*a* carries out the pay-off from the elastic means winding portion 17 as required and, at the same time, takes up or eliminates the excess at the tail end side, thereby avoiding contact at the same position (one point contact).

The rebounding board 7 is not always necessary in implementing the invention, but the presence of the rebounding board can provide return balls with still more variations and enables more realistic exercises.

For example, the rebounding board 7 used in this invention, as shown in FIG. 1, comprises main rebounding boards 7*a*, 7*b* whose upper portion is slightly tilted toward the practice apparatus main body 1 and folded right and left into two parts. Sub-rebounding boards 7*c*, 7*d* are tilted opposite to the main rebounding board and located approximately below a central portion of the height of the main rebounding boards 7*a*, 7*b*. All of the main rebounding boards 7*a*, 7*b* and sub-rebounding boards 7*c*, 7*d* have the central portion slightly retracted away from the main body 1 to the backward side. Conversely, the right and left outer end portions are bent to be brought slightly closer to the ball side. The bending angle of these rebounding boards may be changed as required in accordance with the purpose of the exercise. In this event, the top end side of the sub-rebounding boards 7*c*, 7*d* differs from the bottom end side. The bottom end side is horizontal. The top end side is angled to be slightly higher towards the confluence center point of twofold sub-rebounding boards 7*c*, 7*d*. If configured in this way, the twofold main rebounding boards 7*a*, 7*b* and twofold sub-rebounding boards 7*c*, 7*d*, the upper portions of which are slightly tilted toward the main body 1, define a central portion slightly retracted towards the rear side. Conversely, the right and left end portions are bent in such a manner that they come slightly closer to the ball side. The bending angle of these rebounding boards may be changed as required in accordance with the objects of the exercise. In such an event, the top end side of the sub-rebounding boards 7*c*, 7*d* differs from the bottom end side which is formed to be horizontal. The top end side is formed tilted in such a manner that the top end side is slightly higher towards the confluence center point of twofold sub-rebounding boards 7*c*, 7*d*. If configured in this way, when the upper portion of the twofold main rebounding boards 7*a*, 7*b* is tilted slightly toward the main body 1, the area in which the contact portion between the twofold sub-rebounding boards 7*c*, 7*d* forms line contact also increases. That is, since both rebounding boards are folded in two, bringing both rebounding boards in contact essentially tends to generate point contact. It is desirable to avoid that instability of contact portion resulting from such point contact.

Together with the folding angle of both rebounding boards, the tilting angle can be manually or automatically changed. Though it is not illustrated, the lower end portion of the sub-rebounding boards 7*c*, 7*d* may be comprised, in part, of elastic means such as a spring or rubber biased toward the retracting side. The lower end portion of the sub-rebounding boards 7*c*, 7*d* are pulled to the retracting side manually or automatically using wire, thereby energizing them and improving their rebounding capacity. In order to provide variation to return balls during use, it is possible to automatically repeat this energizing operation of the lower end portion of the sub-rebounding boards 7*c*, 7*d* using a motor with an eccentric cam.

In addition, it is desirable to fix the position of the bend center of the main rebounding boards 7*a*, 7*b* and sub-rebounding boards 7*c*, 7*d* and at the same time to urge both end portions to the retracting side using elastic means such as spring or rubber, and to pull only both end portions of the sub-rebounding boards 7*c*, 7*d* to this side manually or automatically using wire, etc., because the opening angle of both rebounding boards can be adjusted and changed. In this event, it is possible to automatically repeat pulling and retracting operations of both side ends only of the lower end portion of the sub-rebounding boards 7*c*, 7*d* using a motor with an eccentric cam.

The size of the main rebounding board may be, for example, about 1500–2000 mm (59–79 inches) high by about 400–1000 mm (16–39 inches) in total width. The size of the sub-rebounding board may be, for example, about 600–1000 mm (24–39 inches) high by about 400–1000 mm (16–39 inches) in total width.

As an alternative embodiment, when the main body 1 of the practice apparatus shown in FIG. 1 is used to simulate tennis, in addition to the case in which the rebounding board 7 is placed in front, a target apparatus with a hanging target 20 may be placed in front to carry out the exercise. In such an event, the target apparatus may be arranged in place of or side-by-side with the rebounding board 7. It is desirable to arrange the target 20 side-by-side with the rebounding board 7 because more realistic practice can be achieved. The target 20 is hung on the other end of the hanging means 22, installed on the top end of the expandable column 21 in the horizontal direction, free to change positions. The target 20 comprises metal or resin lines and has an annular ring form, and the diameter thereof is free to expand or contract. That is, both ends of the target 20 are unattached. By superimposing both ends on each other, an annular ring of a specified diameter is formed. The ring is tightened to be fixed by the tightening means 23 attached to the other end of the hanging means 22. Releasing the tightening means 23 can easily change the diameter of the target 20. The target 20 is further equipped with a storing portion 24, which is a return prevention mechanism, at the lower portion. If the speed of the ball hit by the exerciser is excessively high, it could be difficult to determine whether the ball enters the target 20 or not. However, if a storing portion 24 is provided in the target 20, when the ball enters the target 20, the ball connection 2*b* of the elastic means connected to the ball B enters the inlet of the storing portion 24, then enters the storing portion 24, stopping the motion of the return ball and accurately indicating that the ball has entered the target 20.

The elastic means 2 is preferably natural rubber, artificial rubber, or other elastic material, but in order to achieve a specified tension, various kinds of materials and profiles can be selected. The elastic means 2 may be a single rubber piece or a plurality of rubber pieces arranged in parallel or in a lump, or the elastic means 2 may be a combined string with the restricting string that can control extension of rubber covered around rubber.

With respect to the profile of the rebounding board 7, in the above embodiment, the rebounding board 7 has a construction to be folded into two from the center portion that forms right and left, but the invention shall not be limited by this. The rebounding board may be one piece of plank or may be a turntable plate equipped with a multiplicity of folding processes.

The ball game practice apparatus according to the invention may be applied to racquetball, squash, and other ball games in addition to application as a tennis practice apparatus.

In addition, besides hanging a rubber-ball baseball or a hardball baseball, a net may be placed in the forward position to which the ball flies so that baseball batting practice can be carried out.

Figure 7:
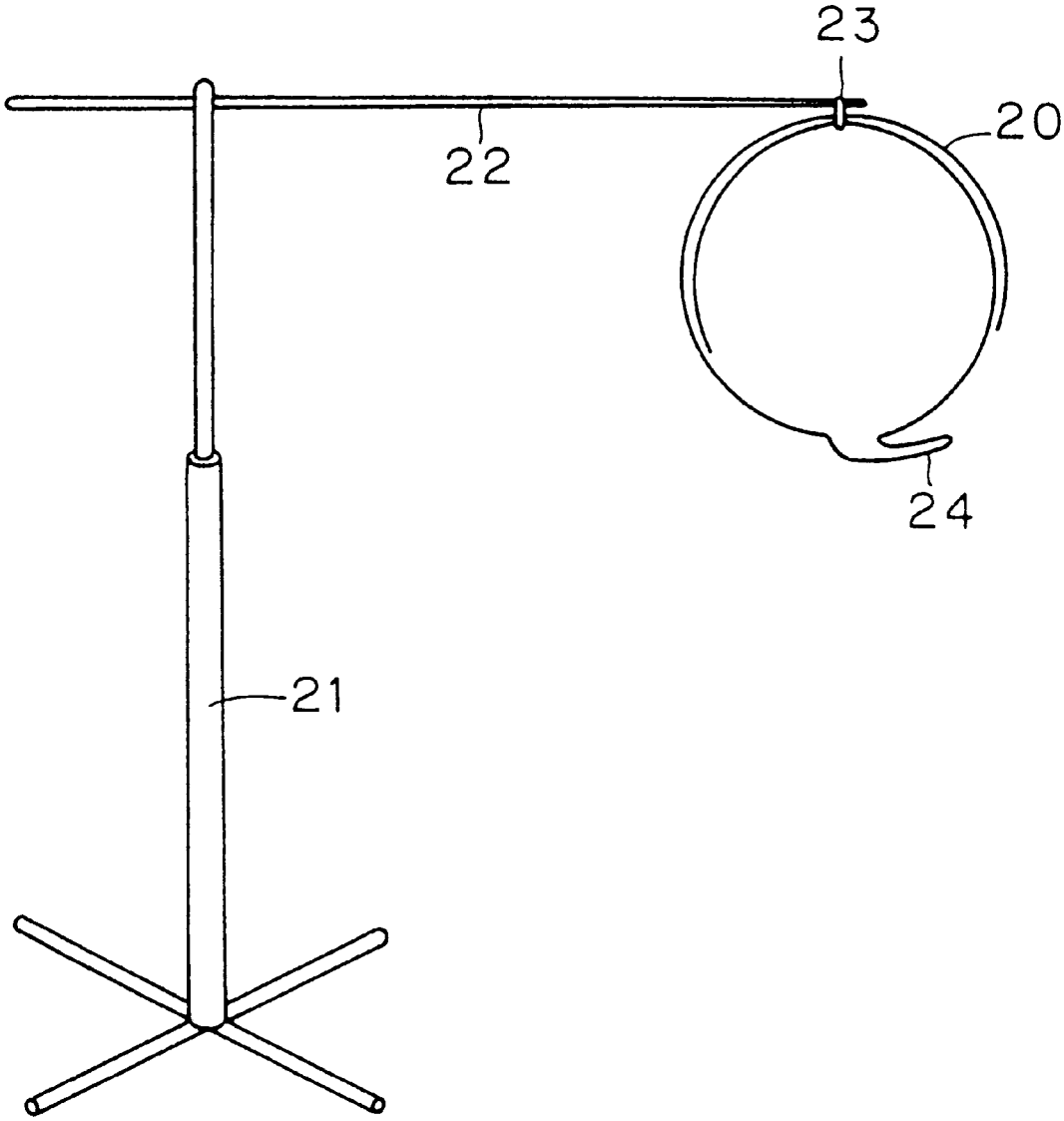
FIG. 7 is an elevation of the target apparatus.

Furthermore, a soccer ball hung on the elastic means is arranged on the ground, and the target shown in FIG. 7 is arranged in front to facilitate soccer practice.

What is claimed is:

1. A ball game practice apparatus comprising:

(A) a ball; and (B) a practice apparatus main body having the ball hanging therefrom, the practice apparatus main body having:

(i) a frame having a front end and a rear end, (ii) an elastic means connected to the frame, and (iii) a column for supporting the frame at a support location approximately midway between the front end and the rear end of the frame wherein the column is adjustable to secure the frame at the support location in a desired vertical position;

wherein:

the frame is adapted to position the ball at a specified predetermined position via the elastic means, the elastic means includes:

a frame connection extending along the frame and mounted to the frame;

a ball connection from which the ball hangs; and at least a pair of turn-back portions each having a smoothly rotatable turn-back mechanism, wherein the frame connection of the elastic means is supported by the frame and is turned back by the pair of turn-back portions, wherein the pair of turn-back portions is mounted to the frame such that the turn-back portions are seperated from each other and the column for supporting the frame is interposed therebetween, wherein the frame connection of the elastic means extends in a longitudinal direction of the frame and is positioned substantially in parallel with the frame, and has a portion which is turned back by the pair of turn-back portions into a direction substantially parallel to the frame;

wherein the ball hung from the ball connection is positioned at the outside of the pair of turn-back portions and at a distal end side of the frame;

wherein the rear end of the frame is restrained by a telescopic element which may be adjusted to a predetermined length to vertically position the rear end of the frame; and wherein the frame is permitted to rotate about the column during play.

2. The ball game practice apparatus according to claim 1, wherein the frame connections are isolated to avoid contact with one another.

3. The ball game practice apparatus according to claim 2, wherein the frame is fixed to the column with a predetermined height and is rotatably pivoted thereto.

4. A ball game practice apparatus according to claim 3, wherein the ball connection of the elastic means includes a plurality of portions forming loops, each of these portions connected via a twist straightening mechanism.

5. A ball game practice apparatus according to claim 3, further including a rebounding board for the ball installed ahead of a ball flying direction.

6. A ball game practice apparatus according to claim 5, wherein the rebounding board is configured to have an adjustable rebounding board surface angle.

7. The ball game practice apparatus according to claim 3, further including a target having a return prevention mechanism which securely prevents a return of the flying ball and wherein the target is installed ahead of a ball flying direction.

8. The ball practice game according to claim 1 further including a rotation restrictor allowing unrestrained rotation within a predefined range of rotation.

9. A ball game practice apparatus comprising:

a vertically adjustable column;

a frame having a front end and a rear end and pivotally supported on the column approximately midway between the front end and the rear end of the frame, wherein the column may be vertically adjusted to vertically adjust the position of the frame at the column;

a telescopic element restraining the rear end of the frame, wherein the telescopic element may be adjusted to a predetermined length to vertically position the rear end of the frame;

an elastic means attached to the frame the elastic means including:

at least a pair of smoothly rotatable pulleys attached to the frame;

a frame connecting line extending along the frame, attached to the frame along a substantially parallel path, having a portion which is turned back by the pair of pulleys so as to become substantially parallel with the frame, and reeled about the pulleys;

a ball connection attached to the frame connecting line; and a ball supported on the ball connection, wherein the ball supported on the ball connection is positioned at the outside of the pair of pulleys and at a distal end side of the frame.

10. The ball game practice apparatus according to claim 9, further including an elastic winding means mounted at the top end of the column, the elastic winding means having the frame connecting line attached thereto.

11. The ball game practice apparatus according to claim 9, wherein the ball connection of the elastic means includes a plurality of loops and a plurality of twist straightening mechanisms.

12. The ball game practice apparatus according to claim 9, further including a rebounding board for the ball located ahead of a ball flying direction.

13. The ball game practice apparatus according to claim 12, wherein the rebounding board is configured to have an adjustable rebounding board surface angle.

14. The ball practice game according to claim 9 further including a rotation restrictor allowing unrestrained rotation within a predefined range of rotation.

* * * * *